US006345440B1

(12) United States Patent
Van Reatherford et al.

(10) Patent No.: US 6,345,440 B1
(45) Date of Patent: Feb. 12, 2002

(54) METHODS FOR MANUFACTURING MULTI-LAYER ENGINE VALVE GUIDES BY THERMAL SPRAY

(75) Inventors: Larry Van Reatherford, Clarkston; Oludele Olusegun Popoola, Novi; Robert Corbly McCune, Southfield, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/621,493

(22) Filed: Jul. 21, 2000

(51) Int. Cl.[7] ..... B23P 15/00

(52) U.S. Cl. ..... 29/888.41; 29/888.44; 29/527.2

(58) Field of Search ..... 29/888.41, 888.44, 29/527.2; 427/453, 454, 456; 137/1; 123/188.9

(56) References Cited

U.S. PATENT DOCUMENTS

| | | | | |
|---|---|---|---|---|
| 3,340,084 A | | 9/1967 | Eisenlohr | |
| 4,185,368 A | * | 1/1980 | Kammeraad | 29/888.41 |
| 4,424,953 A | | 1/1984 | Takagi et al. | |
| 4,465,040 A | * | 8/1984 | Pelizzoni | 29/888.41 |
| 4,671,491 A | | 6/1987 | Kuroishi et al. | |
| 5,041,168 A | * | 8/1991 | Purnell et al. | 29/888.41 |
| 5,060,713 A | | 10/1991 | Reichelt et al. | |
| 5,110,631 A | | 5/1992 | Leatham et al. | |
| 5,493,776 A | * | 2/1996 | Kammeraad et al. | 29/888.41 |
| 5,539,980 A | * | 7/1996 | Kammeraad et al. | 123/188.9 |
| 5,592,927 A | | 1/1997 | Zaluzec et al. | |
| 5,817,267 A | | 10/1998 | Covino et al. | |
| 5,819,774 A | | 10/1998 | Beardsley et al. | |
| 5,983,495 A | | 11/1999 | Popoola et al. | |

* cited by examiner

*Primary Examiner*—I Cuda Rosenbaum
(74) *Attorney, Agent, or Firm*—Damian Porcari

(57) ABSTRACT

A method of making valve guides by thermal spraying a wear-resistant layer onto a rotating mandrel that is subsequently built up by thermal spraying steel on the wear-resistant layer. A flame spray polymer lubricant may be applied to the wear-resistant layer to improve self-lubricating properties of the engine valve guide. The mandrel and applied layers are then cut off and the remaining segment is further processed in a machining operation to remove the mandrel from the inside of the engine valve guide. The mandrel is preferably cooled as the thermal spray is applied preferably by routing a cooling fluid such as air through the mandrel.

13 Claims, 1 Drawing Sheet

METHODS FOR MANUFACTURING MULTI-LAYER ENGINE VALVE GUIDES BY THERMAL SPRAY

TECHNICAL FIELD

The present invention relates to a method of making valve guides by thermal spray on a cylindrical substrate.

BACKGROUND ART

Valve guides are used in aluminum engines to guide the movement of the stems of valves in an engine cylinder head. Prior art cast iron engines normally do not require valve guides due to the self-lubricating qualities of the graphite constituent in the cast iron base material of the cast iron engine heads and the wear-resistant nature of the cast iron itself. The self-lubricating and wear-resistant capacity of cast iron contribute to long life with minimum lubrication. Valve guides for aluminum engine heads are generally produced from cast iron or by powder metal processes and are installed on a machining line along with the valve seats.

Valve guides must resist wear over the life of a vehicle. If a engine valve guide becomes worn it may adversely affect engine durability, oil consumption and emission performance. Aircraft and diesel engine valve guides may be subjected to extreme use and long service life that increases the potential for wear. In automotive applications, wear of engine valve guides can develop over time. Valve guide wear can lead to reduced engine durability and increased oil consumption and emissions in engines that have been operated typically for more than 100,000 miles.

Powder metal valve guides manufactured with steels having a high molybdenum content offer good wear resistance but are relatively costly.

Prior art methods of making valve guides have failed to provide a cost-effective method of making valve guides that are both durable and self-lubricating, thereby minimizing oil consumption and engine emissions at high mileage.

The above problems and objectives are addressed by applicants' invention as summarized below.

DISCLOSURE OF INVENTION

According to the present invention a method of making an engine valve guide is provided by feeding and rotating a tubular mandrel as it is advanced into a spray booth or enclosure. The mandrel is thermally sprayed with a composite layer consisting of from 0–50% by volume of a self-lubricating polymer in a matrix of wear-resisting metal. The self-lubricating, wear-resistant layer on the mandrel is then sprayed with additional, outer layers of a base metal. Predetermined lengths of the mandrel, wear-resistant layer and additional layers are then cut off. The mandrel is then removed from the wear-resistant layer and additional layers leaving a tubular engine valve guide having an internal wear-resistant layer.

The mandrel may either be uncoiled from a roll of tubing and straightened before being fed into the spray booth or, alternatively, may be provided as straight sections.

According to the method, the wear-resistant, self-lubricating material is a composite consisting of a thermally-stable polymer in a matrix consisting of a wear-resistant metal, metal alloy or metal-metal oxide composite, as occurs naturally when oxidizable metals are thermally sprayed in an air or oxygen-containing atmosphere. The method may also comprise flame spraying a powder polymeric material in conjunction with thermal spraying the wear-resistant material. Application of the polymeric material may be simultaneous with or subsequent to beginning application of the wear-resistant material. The polymeric material may be applied by means other than thermal spray such as wet or dry spray application at ambient temperature. The additional layers of material thermally sprayed on the wear-resistant layer are preferably steel.

According to the method, the step of cutting off the mandrel is performed by a flying cut-off machine. After the lengths of tubing have been cut off, the step of removing the mandrel from the wear-resistant layer may be performed in a machining operation. For example, the machining operation may consist of drilling, broaching, water jet cutting, reaming, or combinations of such machining operations. The material forming the mandrel is selected from the group consisting of aluminum, brass, steel or copper.

A cooling medium is directed through the mandrel as the tubing is fed into the spray booth and while the wear-resistant, lubricant and additional layers are applied to the tubing. The cooling medium may be air, water or another fluid that is capable of cooling the mandrel during the spray forming steps.

These and other advantages of the present invention will be more clearly understood in view of the attached drawings and in light of the following detailed description of the invention.

BEST MODE FOR CARRYING OUT THE INVENTION

Figure 1:
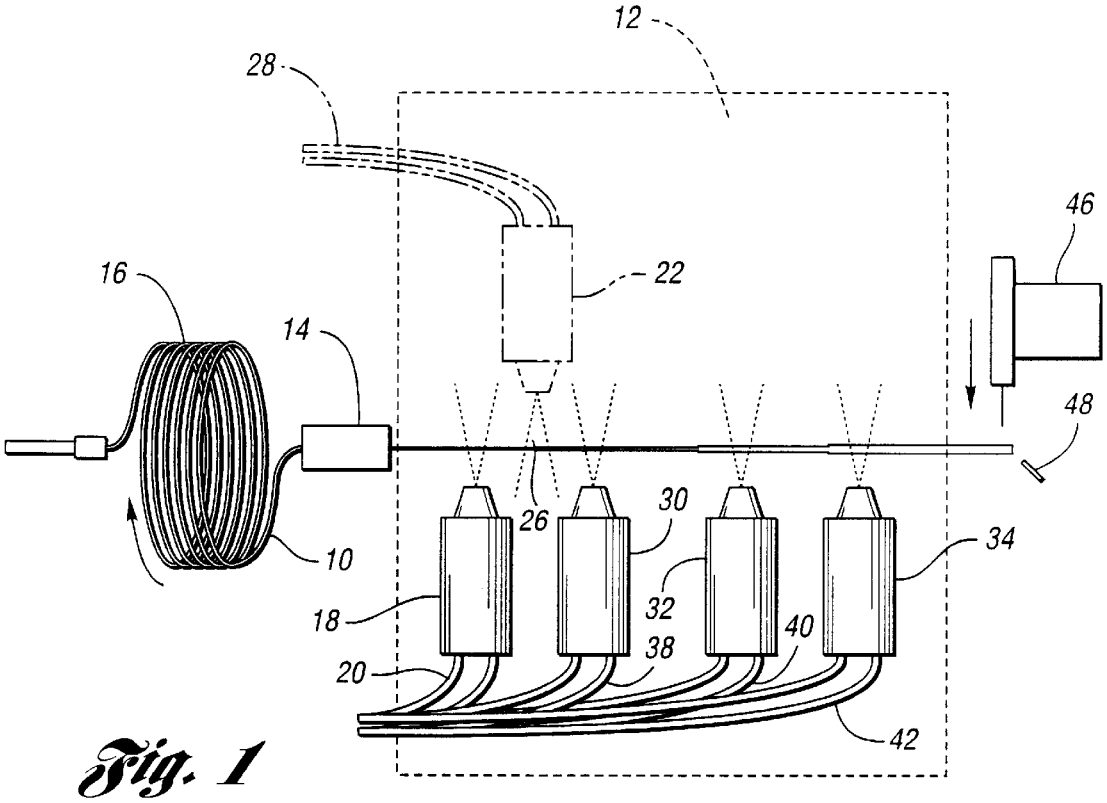
FIG. 1 is a schematic view of a system for manufacturing multi-layer engine valve guides by thermal spray according to the present invention.

Referring now to FIG. 1, a mandrel 10 is shown being fed into a spray booth 12 through a straightener 14 that also rotates the mandrel 10. The mandrel 10 as shown in FIG. 1 is unreeled from a coil 16 and fed into the straightener 14. It should be understood that the mandrel could be provided as straight lengths of tubing that would not require the coil straightener 14. As the mandrel 10 is fed into the spray booth 12, it is acted upon by a first thermal spray applicator 18 that sprays a wear-resistant material. The first spray applicator 18 is preferably a two-wire arc gun operating with air as the propellant. It will be apparent, however, that other thermal spray guns or applicators including plasma torches, flame torches, high-velocity oxy-fuel torches, detonation guns or "cold-spray" applicators could also be used with their respective feedstock materials in the form of powders or wires. As the metal is sprayed from arc gun 18 on the mandrel 10, the mandrel is rotated so that an even layer of wear-resisting material is applied to the mandrel.

A flame spray gun 22 is provided in conjunction with or immediately after the first applicator 18 that flame sprays a polymer powder 26. The flame spray gun 22 is provided with a gas supply line 28 that preferably supplies propane to the flame spray gun 22. It will be apparent that the self-lubricating polymer powder may be introduced to the growing composite surface by means of other powder introduction systems including dry powder spraying at low velocity, "cold spraying" of polymer powders at high velocity and "wet" spraying of powders using appropriate solvents or carriers and atomizing nozzle.

Second, third and fourth arc guns 30, 32, 34 are provided with second, third and fourth wires 38, 40, 42 that each spray metal from the wires 38, 40, 42 on the mandrel 10 as it is rotated. Second, third and fourth wires 38, 40, 42 are preferably of plain carbon steel of grades having up to 0.8% carbon by weight that is used to build up the metal deposit on the mandrel 10 as it transits the spray booth. As the mandrel 10 exists the enclosure 12 a flying cut-off machine 46 is used to cut the mandrel into segments 48 that include the mandrel and the layers of material that have been sprayed on the mandrel.

Figure 2:
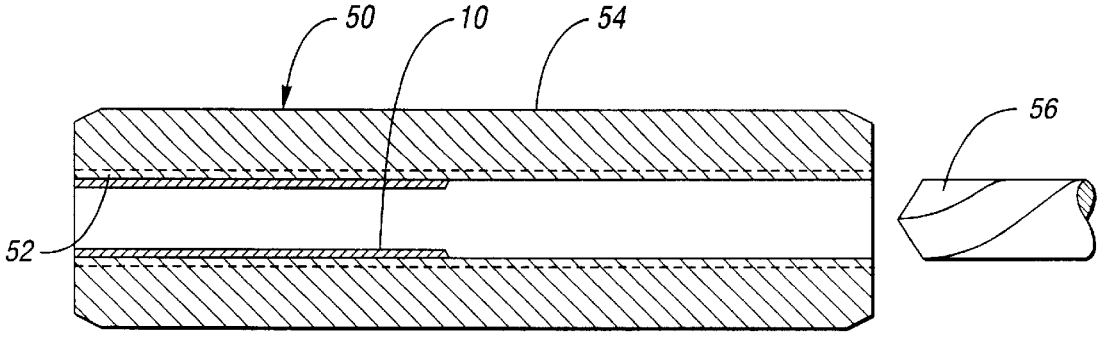
FIG. 2 is a cross sectional view of a multi-layer engine valve guide made in accordance with the present invention.

Referring now to FIG. 2, an engine valve guide 50 made in accordance with the present invention is shown. The engine valve guide 50 includes a wear-resistant layer 52 on the inner diameter of a backing layer 54. The wear-resistant layer 52 is formed by the spray of the first arc gun 18 while the backing layer 54 is formed by the second third and fourth arc guns 30, 32, 34.

Referring to the wear-resistant constituent of the composite layer 52, the wear-resistant matrix materials are rendered into coatings through any of several thermal spray processes operating in air atmosphere. Materials refer to the raw feedstock and not to the coating formed as a result of thermal spraying. Coatings formed as a result of thermal spraying these materials will contain oxidation products incorporated in the resultant coating or deposit. Examples of wear-resistant matrix materials are listed below:

Plain carbon steels up to 0.8% carbon, containing manganese as the principal alloying addition.

"Self-fluxing" hard-facing alloys comprised of nickel, chromium, silicon and boron.

Hard-facing alloys comprised of iron, chromium, silicon and boron.

Nickel-based super alloys containing primarily nickel and chromium with additions selected from molybdenum, tungsten, cobalt, vanadium and carbon.

Alloy steels comprised of iron with additions selected from: manganese, chromium, carbon, vandium, molybdenum, nickel tungsten and silicon.

Cobalt-based alloys containing additions selected from: chromium, molybdenum, silicon, nickel carbon and iron.

Nickel-based hard-facing alloys containing elements selected from cobalt, iron, molybdenum, chromium, tungsten, manganese, silicon and carbon.

It is also anticipated that mixtures of the above materials could be used.

After the segment 48 is cut off it is taken to a machining fixture where it is drilled, broached, reamed or cut with a water jet to remove the mandrel 10 from the wear-resistant layer 52 and backing layer 54. As shown in FIG. 2, a portion of the mandrel 10 has been removed from the engine valve guide by a drill 56.

While the present invention was described in the context of forming the engine valve guides with a single mandrel. It should be understood that more than one mandrel could be processed through the spray enclosure 12 to manufacture the engine valve guides on a production basis. This may reduce loss of thermal spray material caused by over-spray and would increase manufacturing efficiency.

While the invention has been described with reference to a best mode including particular materials that are either spray applied or applied with a flame gun it should be understood that different materials may be used for both the thermal spray layer in both the wear-resistant layer 52 and backing layers 54 and also that different polymers or other solid lubricant materials may be applied with the flame spray gun 22. The flame spray gun 22 and application of polymers could be eliminated without deviating from the spirit and scope of the present invention.

The mandrel 10 may be formed of aluminum or it could also be formed of brass, steel or copper.

The thermal spray applicators used to spray metal on the mandrel are preferably operated in air so that oxides are formed as the metal is sprayed on the mandrel. For metals such as iron and molybdenum, oxide phases formed during thermal spraying produce self-lubricating microstructures. The first spray layer applied by the first gun 18 and composite polymer or solid lubricant introduction from the second gun or applicator 22 should normally be less than 0.010 of an inch. This is beneficial since there is desire to minimize the quantity of wear-resistant, alloy wire applied to the mandrel 10. The wear-resistant layer 52 could also be formed of a chromium-containing steel alloy or other materials such as composites of nickel—chromium alloy (e.g. Inconel 625) and low alloy steels. Other materials that could be used as a wear-resistant coating include Stellite, nickel—aluminum—bronze or nickel—chrome. If desired, cored wires having wear-resistant particles in a spray metal binder could be used to enhance the properties of the wear surface.

The powder polymer flame spray gun 22 can be used to apply a polymer such as poly ether-ether ketone, polytetrafluroethylene, polyamide, or other polymers. The polymers to be used for the application must be thermoplastics with glass transition and melting temperatures above 200° F. and 400° F. respectively. The solid lubricating polymers can be from ketones, polyamides, and polycarbonates. With or without the flame sprayed polymer application, wear-resistant layer 52 provides a wear-resistant and durable interior surface of the finished valve guide.

While the invention is shown with three arc spray guns that apply the plain carbon backing layer 54, it is believed that a greater number or fewer number of guns could be provided depending upon production requirements and the thickness of the backing layer 54 to be developed on the wear-resistant layer 52. Formation of the backing material plain steel is intended to minimize cost. Other metals could be used as the backing material.

It is desirable to internally cool the mandrel 10 with a liquid or gas such as air flowing internally through the coil.

While the best mode for carrying out the invention has been described in detail, those familiar with the art to which this invention relates will recognize various alternative designs and embodiments for practicing the invention as defined by the following claims.

What is claimed is:

1. A method of making an engine valve guide comprising:

rotating a mandrel and feeding the mandrel into a spray booth;

spraying the mandrel with a wear-resistant material to apply a wear-resistant layer on the mandrel;

applying polymeric material in conjunction with spraying the mandrel with wear-resistant material to form a wear-resistant and self-lubricating composite layer;

spraying the wear-resistant and self-lubricating composite layer with a base metal to apply additional layers on the mandrel;

cutting off predetermined lengths of the mandrel including the wear-resistant layer and additional layers; and removing the mandrel from the wear-resistant layer and additional layers leaving a tubular engine valve guide.

2. The method of claim 1 further comprising uncoiling the mandrel from a roll of tubing and straightening the tubing before feeding the mandrel into the spray booth.

3. The method of claim 1 wherein the wear-resistant material is a steel alloy.

4. The method of claim 1 wherein the wear-resistant material is a cobalt alloy.

5. The method of claim 1 wherein the wear-resistant material is a nickel alloy.

6. The method of claim 1 wherein the step of applying a polymeric material further comprises performing flame spraying, liquid suspension spraying, or dry spraying polymeric material on the mandrel.

7. The method of claim 1 further comprises selecting a polymeric material from the group consisting essentially of:

polytetrafluoroethylene;

poly ether-ether ketone; or polymide.

8. The method of claim 1 wherein the step of cutting off predetermined lengths of the mandrel further comprises cutting the mandrel with a flying cutoff machine.

9. The method of claim 1 wherein the step of removing the mandrel from the wear-resilient layer and self-lubricating layer and additional layers further comprises machining the mandrel.

10. The method of claim 9 further comprises selecting a machining operation from the group consisting of essentially drilling, broaching, water jet cutting or reaming and combinations thereof.

11. The method of claim 1 further comprises selecting a material for forming the mandrel from the group consisting of aluminum, brass, steel or copper.

12. The method of claim 1 further comprising directing a cooling medium through the mandrel while the mandrel is fed into the spray booth and during the spraying steps.

13. The method of claim 1 further comprises directing air, water or an aqueous coolant solution through the mandrel.

* * * * *